United States Patent [19]

Dodd et al.

[11] Patent Number: 4,962,336

[45] Date of Patent: Oct. 9, 1990

[54] IGNITOR DISABLER

[75] Inventors: Peter G. Dodd, Scarborough; Stephen G. MacNeil, Newcastle, both of Canada

[73] Assignee: Cooper Industries, Inc., Houston, Tex.

[21] Appl. No.: 157,555

[22] Filed: Feb. 19, 1988

[30] Foreign Application Priority Data

Jan. 22, 1988 [CA] Canada ..... 557223

[51] Int. Cl.[5] ..... H05B 41/14

[52] U.S. Cl. ..... 315/290; 315/DIG. 7

[58] Field of Search ..... 315/119, 120, 121, 123, 315/127, 128, 129, 131, 289, 290, DIG. 5, DIG. 7

[56] References Cited

U.S. PATENT DOCUMENTS

| | | | |
|---|---|---|---|
| Re. 29,204 | 5/1977 | Snyder | 315/106 |
| 4,179,641 | 12/1979 | Britton | 315/289 |
| 4,307,353 | 12/1981 | Nilssen | 331/113 A |
| 4,438,372 | 3/1984 | Zuchtriegel | 315/224 |
| 4,513,364 | 4/1985 | Nilssen | 363/132 |
| 4,544,863 | 10/1985 | Hashimoto | 315/209 R |
| 4,677,345 | 6/1987 | Nilssen | 315/209 R |
| 4,763,044 | 8/1988 | Nuckolls et al. | 315/176 |
| 4,810,936 | 3/1989 | Nuckolls et al. | 315/119 |
| 4,896,077 | 1/1990 | Dodd et al. | 315/289 |

*Primary Examiner*—David Mis

*Attorney, Agent, or Firm*—Blake, Cassels & Graydon

[57] ABSTRACT

An ignitor disabler for the starter circuit of a High Intensity Discharge (HID) lamp includes means for disabling the ignitor, and means for triggering the disabling means of the ignitor after passage of a predetermined amount of time. The triggering means has a timing component that begins time measuring operation only under certain, predetermined conditions. The disabler includes means for resetting the timing component of the triggering means upon lamp ignition. In its preferred embodiment, the starter circuit specifically includes AC threshold voltage establishing means and a field effect transistor for ensuring that a timing capacitor in the disabler triggering circuit is effectively discharged to zero volts. The disabler trigger circuit may operate down to minus 40° C.

19 Claims, 3 Drawing Sheets

IGNITOR DISABLER

BACKGROUND OF THE INVENTION

1. Field of the Invention

This invention relates to ignitor disablers for vapour discharge lamps, and more particularly, to ignitor disablers which are suitable for disabling ignitors employed igniting and operating circuits for High Intensity Discharge (HID) lamps, particularly of the high pressure sodium type.

2. Background of the Prior Art

High intensity discharge (HID) lamps are used in many applications because of their long life and high efficiency for converting electrical energy to light. The principal types of HID lamps are mercury vapour, metal halide and high pressure sodium (HPS).

Mercury vapour, metal halide and HPS lamps all operate similarly during stabilized lamp operation. The visible light output results from the ionization of gases confined within an envelope and which must be broken down before there is any flow of ionization current. For this reason, a high open circuit voltage must be applied to a HID lamp for igniting and this voltage is substantially higher than the operating voltage and the available line voltage.

Another characteristic of HID lamps is that they exhibit negative resistance; that is, when operating, their resistance decreases with increase in the applied voltage. As a result, such devices require an impedance means in their power supply circuit for limiting the current flow to a predetermined value.

Because of the high starting or igniting voltage requirement and the negative resistance characteristic, HID lamps are provided with igniting and operating circuits which provide a relatively high open circuit voltage and impedance means for current limitations. A ballast between the power supply and the lamp typically services as the impedance means in igniting and operating circuits for HID lamps. For some HID lamps, such as mercury vapor lamps, igniting voltages are on the order of two times the operating voltage. The igniting voltage is generated by the ballast acting in conjunction with a capacitor. For other types of HID lamps, such as HPS lamps, wherein the required igniting voltages are typically more than ten times the operating voltages, more complex igniting mechanisms are required. Examples of starting or igniting circuits for such lamps are disclosed in U.S. Pat. No. 4,322,660 to Johnson and U.S. Pat. No. 4,683,404, to Hitchcock. The Johnson patent discloses an apparatus for providing high voltage pulses for starting a HPS discharge lamp, the apparatus having a single capacitor in series with a blocking diode and a charging resistor. When the voltage of the capacitor reaches a predetermined voltage exceeding the zener voltage of a parallel zener diode, the capacitor discharges through a ballast which is connected in autotransformer relationship therewith to provide the high voltage pulse to start the lamp. Hitchcock discloses an apparatus including two capacitors, two blocking diodes, a voltage sensitive symmetrical switch, and multiple resistances across which pulses are distributed. The aforementioned elements are electrically connected together and with a tapped ballast reactor so that one of the capacitors charges through an impedance in the negative half-cycle, and thereafter, when line voltage goes positive the other capacitor charges through an impedance equal to the sum of the multiple resistances. When the voltage of the capacitors reaches a predetermined voltage exceeding the breakdown voltage of the voltage sensitive symmetrical switch, the capacitors discharge. This discharge, because of an autotransformer relationship within the reactor, produces a high voltage pulse of predetermined height and width once per each cycle of the source voltage.

Notwithstanding the many similarities noted above between the various types of HID lamps, there are, however, unique requirements for HPS lamps which the ballast system typically provides. As discussed in the preceding paragraph, some type of electronic ignitor is used in conjunction with the HPS ballast coils to produce a high voltage pulse to start the HPS lamp. In all cases, these electronic ignitors work on the principle of sensing whether or not the lamp is burning, and if not, the ignitor continuously supplies starting pulses to the lamp. Electronic ignitors are generally insensitive to reasons why the lamp is not burning, and, accordingly, function in the same manner regardless of whether the non-burning of a lamp is caused by lamp failure, by absence of a lamp in the lamp socket, or by the lamp "cycling" off. Lamp cycling is a well known phenomenon in which a lamp nearing the end of its life will light, burn for some time, go out, relight and repeat this cycle time after time, until the lamp is either replaced or will fail to start at all. This phenomenon is due to the characteristic life trend of the lamp operating voltage in a HPS lamp. As a HPS lamp nears the end of its life, its lamp operating voltage gets so high that the ballast will no longer sustain operation. This condition usually manifests itself as an above-described "cycling" lamp. Further information about this phenomenon is set forth in an article entitled "Recommendations for Lamp Maintenance in High Pressure Sodium Luminaries" in Main-Lighter—Official Publication of the INTERNATIONAL ASSOCIATION OF LIGHTING MAINTENANCE CONTRACTORS, Volume 10, Number 7, page 1 (December 1982).

From the foregoing, it should be clear that there are a number of shortcomings in the prior art. In certain cases, e.g. when a lamp is cycling, failed or missing, the ignitor in the lamp's HID circuit continues to operate. Such operation shortens ignitor life, particularly in cases where the ignitor operates in conjunction with the ballast so that more than normal excitation power is drawn by the ballast transformer; that is, to be more specific, where the ballast coil is stressed as a consequence of the ignitor operation. Cycling lamps can also cause problems by possibly avoiding easy detection of impending failure. A lamp may be "cycling on" when inspected and, hence, escape replacement. In situations where obtaining access to lamps is difficult and inspections are not frequent, such as when the lamps are used for roadway lighting, failure to detect a cycling lamp will inevitably lead to futile ignitor operation and consequent deterioration.

SUMMARY OF THE INVENTION

To overcome the above-described shortcomings in the prior art, and to provide other advantages and new features described in greater detail below, the present invention, either incorporated into or designed for retrofit into an igniting and operating circuit for a lamp, includes means for disabling the ignitor after passage of a predetermined amount of time, the means for triggering the disabler having a timing component for measuring the predetermined amount of time, which timing component begins time measuring operation only under certain predetermined conditions; there being means for maintaining the length of the predetermined amount of time generally constant over temperatures ranging from at least one hundred (100° C.) degrees Celsius to at least minus forty (−40° C.) degrees Celsius; and means for resetting the timing component of the disabler triggering means upon lamp ignition.

Accordingly, one object of the present invention is to disable ignitors for HPS lamps under fault or "no lamp" conditions. Another object of the present invention is to increase the effective lives of ignitors and ballasts in HPS lamp igniting and operating circuits by preventing lamp cycling and unnecessary starter operation that can foster high voltage insulation breakdown. Yet another object of the present invention is to give a lamp user a clear indication of end of lamp life. Still another object of the present invention is to provide a unit that is substantially independent of the ballast and can therefore be used in conjunction with any standard ballast ignitor currently commercially available for conventional HPS lamps. A further object of the present invention is to provide an ignitor disabler unit that can be retrofitted to any existing installation at minimum cost, since the ballast does not have to be changed to accommodate the function. A still further object of the present invention is to provide an ignitor disabler unit which will be effective over a wide range of atmospheric temperatures. The adoption of a Programmable Unijunction Transistor in the disabler trigger circuit conveys unexpected stability to the combination over a wide temperature range, including an increased time constant at lower temperatures, to more nearly match the low temperature characteristics of HPS lamps, thus enabling use thereof to at least minus 40° C.

Other objects, advantages, and new features of the invention will become apparent from the following detailed description of the invention when considered in conjunction with the accompanying drawings wherein:

DETAILED DESCRIPTION OF THE INVENTION

Figure 1:
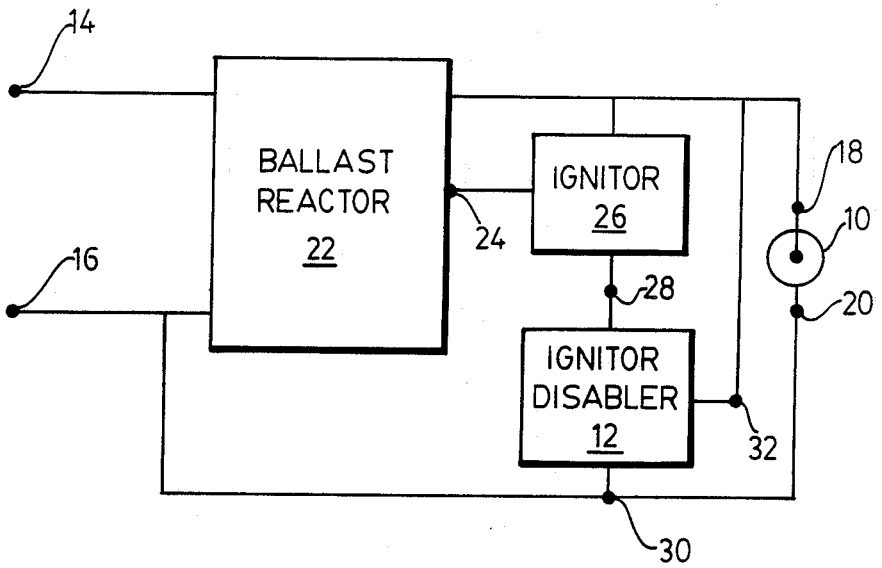
FIG. 1 is a block diagram of an igniting and operating circuit for a HPS lamp, the circuit including therein an ignitor disabler according to the present invention.

In FIG. 1 is shown a schematic diagram of a circuit for connection across an AC source for igniting and operating a HPS lamp 10. The circuit includes an ignitor disabler 12 according to the present invention. The circuit comprises input terminals 14, 16 operable to be connected across the AC source, and output terminals 18, 20 having the lamp 10 connected there, across.

A convention ballast reactor 22 has a tap 24 intermediate the ends thereof which defines the junction of first and second winding portions, the first winding portion generally having a greater length than the second winding portion, and having a transformation ratio therebetween substantially greater than unity. The ballast reactor 22 is connected at its end between input terminal 14 and output terminal 18, with the second winding portion connected to the output terminal 18. Input terminal 16 electrically connects the output terminal 20. Details regarding this type of structure and its function are very well known to those skilled in the art and are discussed at length in numerous references, including U.S. Pat. No. 4,107,579 to Bodine. Likewise those skilled in the art recognize the desirability in many cases of including a power correction capacitor (not shown) in HPS lamp circuits. As details regarding inclusion and placement of such a capacitor are well known, they are not discussed further herein.

A conventional ignitor, such as described in the prior art section above, is connected across a second winding portion of ballast 22 so as to exploit the inherent autotransformer relationship therein and thus be capable of generating a high voltage pulse to ignite lamp 10. As can be seen in FIG. 1, this connection across the second winding portion of ballast 22 is accomplished by electrically connecting ignitor 26 at some point within its system to tap 24 and at some other point within its system to output terminal 18. Whereas in conventional igniting and operating circuits for HPS lamps, and note is made here of the teachings in U.S. Pat. No. application Ser. No. 912,037, recently allowed, the igniting 4,683,404, in the circuit shown in FIG. 1 a new element 12, the ignitor disabler according to the present invention, is inserted between ignitor 26 and output terminal 20. As is further shown in FIG. 1, at some point the ignitor disabler system according to the present invention also connects to output terminal 18.

For clarity and convenience, at this point terminal connections to what can be considered an independent ignitor disabler system or retrofittable unit, are designated ignitor disabler terminals 28, 30, 32. Referring to FIG. 1, terminal 28 can be seen to electrically connect to some point within the ignitor 26 system, terminal 30 can be seen to electrically connect to output terminal 20, and terminal 32 can be seen to electrically connect to output terminal 18.

Figure 2:
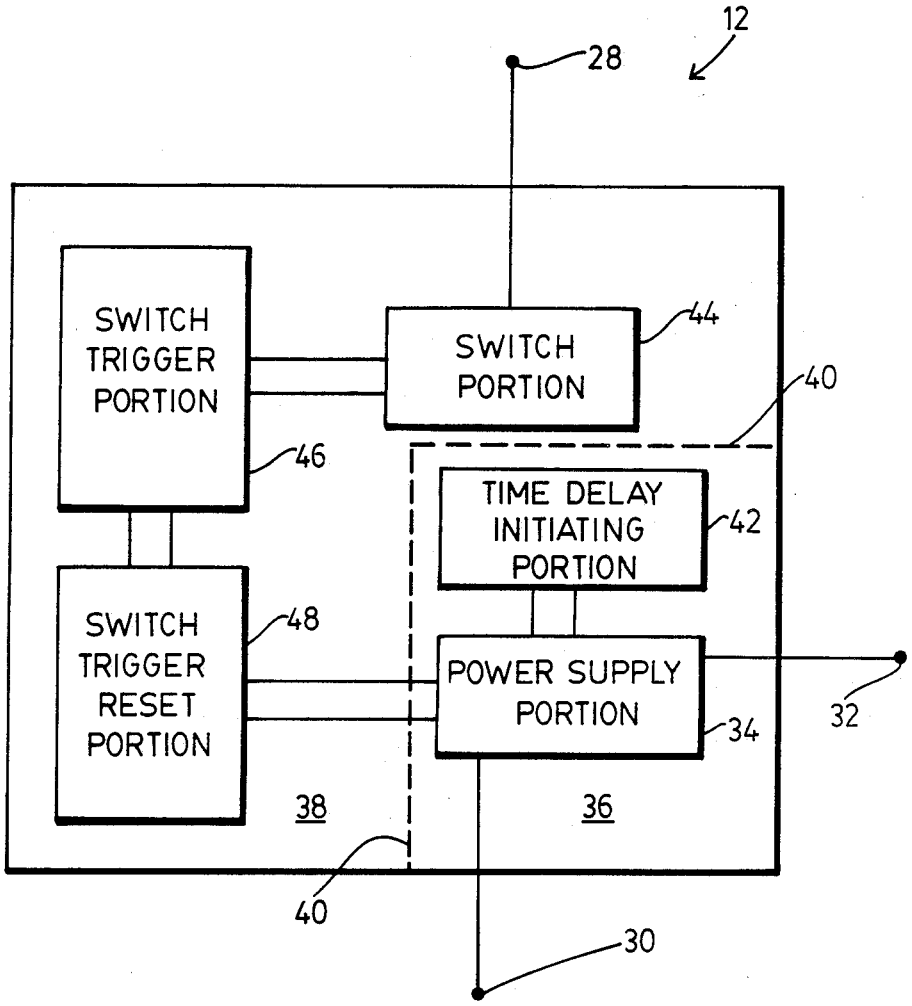
FIG. 2 is a block diagram showing sub-portions of an ignitor disabler according to the present invention.

Referring now to FIG. 2, the ignitor disabler 12 is shown therein in greater detail. Major subcomponents of the disabler 12 are depicted by individual blocks. Terminals 30 and 32 can be seen to electrically connect to a power supply portion 34. Power supply portion 34 is designed to convert alternating current from the ballast secondary winding to direct current. Accordingly, power supply portion 34 effectively divides disabler 12 into an AC part 36 and a DC part 38, the border between the respective parts being designated by dashed line 40. It is important to note that the time delay initiating portion 42 is depicted as operating within the AC part 36 of disabler 12. The purpose and function of portion 42 and further details about this aspect of the present invention are discussed in greater detail below.

Terminal 28 can be seen to electrically connect to a switch portion 44. Switch portion 44 is designed to generate an ignitor disabling signal for transmission to ignitor disabler 12 via terminal 28 under certain predetermined conditions. Switch portion 44 is connected to and triggered by a switch trigger portion 46. Under certain predetermined conditions, portion 46 is designed to trigger portion 44, thereby transmitting an ignitor disabling signal out of the disabler via terminal 28. Under the teaching of the present invention, the certain predetermined conditions involve passage of a certain predetermined amount of time. Accordingly, switch trigger portion 46 includes a timing component for measuring time.

Switch trigger portion 46, already discussed as being connected to switch portion 44, is also connected to a switch trigger reset portion 48. Switch trigger reset portion 48 is designed to sense through various connections which ultimately lead to terminals 30 and 32, across which lamp 10 is connected, lamp 10 ignition. Once switch trigger reset portion 48 senses lamp 10 ignition, it resets trigger portion 46 by, under the teaching of the present invention, stopping and immediately resetting to zero the timing component within the switch trigger reset portion.

Referring back to time delay initiating portion 42, mentioned only briefly above, that portion 42 is designed, in part, to perform the opposite function of switch trigger reset portion 48. Whereas switch trigger reset portion 48 stops and immediately resets to zero the timing component of switch trigger portion 46, time delay initiating portion 42 sets the timing component into operation. Once the timing component is set into operation, by means discussed immediately below, unless the reset portion subsequent senses lamp ignition and terminates time measurement, switch trigger portion 46 will trigger switch portion 44 and cause transmission of an ignitor disabling signal out of disabler 12. Two important aspects of portion 42 under the teaching of the present invention should be noted. First, portion 42 include means for establishing a threshold voltage. As discussed in the description of a preferred embodiment below, this threshold voltage can be used as a bench mark for establishment of the certain predetermined conditions which begin the measuring of time within the switch trigger portion 46. For example, as in the preferred embodiment described below, this threshold voltage could be compared to the operating voltage of a lamp 10 and systematically connected so as to begin the time measuring if and when the lamp operating voltage exceeds the threshold voltage. It should be remembered, as discussed in the background of the prior art section above, that a HPS lamp's operating voltage rises as the lamp nears the end of its life, so that occurrence of an operating voltage becoming greater than a threshold voltage is an effective timing trigger. A second important aspect of portion 42 is that it is designed to operate in the previously described AC part 38 of disabler 12. In conventional practice, threshold voltages are set in the DC parts of circuits. There are a number of advantages in establishing a threshold in the AC part of a circuit including less complexity of construction. These advantages, and the awareness that this is an exceedingly novel feature of applicants invention, should become clear to those skilled in the art upon examination of the example of the preferred embodiment described immediately below.

Figure 3:
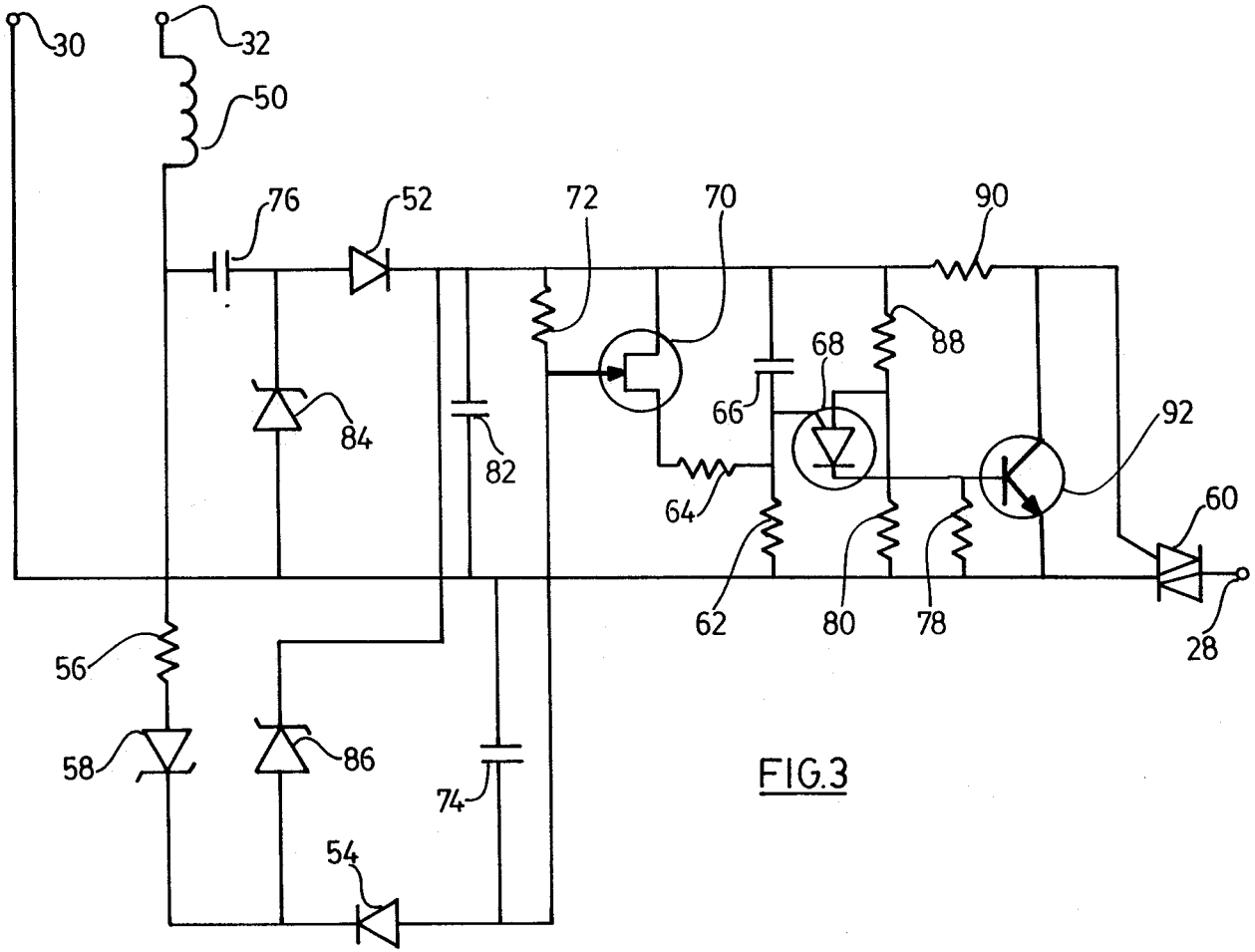
FIG. 3 is a circuit diagram of a preferred embodiment of an ignitor disabler according to the present invention.

Referring now to FIG. 3, shown herein is a circuit diagram for a preferred embodiment of the ignitor disabler of the present invention. The particulars of this illustrative embodiment are especially suitable for use with conventional HPS lamps up to 150 watts, maximum. The topography is basically the same as in FIG. 2 except for including some circuit details for practical application. Terminals 32, 30, 28 correspond to the identically numbered terminals in FIGS. 1 and 2.

The power supply portion of the circuit of FIG. 3 comprises choke 50 and rectifying diodes 52, 54. Of course, it should be readily apparent to those skilled in the art that alternating current applied across terminals 32, 30 will be converted to direct current by operation of diodes 52, 54.

The time delay initiating portion, which, as mentioned above, performs an AC threshold function, comprises dropping resistor 56 and zener diode 58.

The switch portion of disabler 12 comprises a bidirectional triode thyristor or triac 60. Triac 60 is inserted between terminal 28 and switch trigger portion 46. In FIG. 3, the switch trigger portion comprises resistors 62, 64, 78, 80, 88, capacitor 66, programmable unijunction transistor (PUT) 68 and bi-polar transistor 92. The PUT 68 enables the time delay to be maintained substantially constant within a very wide temperature range from at least one hundred (100° C.) degrees celcius to at least minus forty (−40° C.) degrees celcius, below the lower temperature, so as to offset the low temperature characteristics of HPS lamps. Those skilled in the art will appreciate that the resistor 62 and capacitor 66 constitute a conventional RC timing network which operates in conjunction with PUT 68, transistor 92, and resistors 78, 80, 88 and 90 to apply a "trigger" pulse to the gate of triac 60. In preferred embodiments of the present invention, of which the embodiment of FIG. 3 is an example, the built-in time delay will be sufficient to accommodate momentary interruption of power resulting in lamp outage. As is well known to those skilled in the art, lamp and fixture combinations, after operating for some time and being extinguished, must cool down to a certain degree before the lamp is capable of being reignited. In such hot restrike circumstances, if sufficient time is not allowed for the ignitor to remain in the "on" mode past the cool down period, the high voltage restrike pulses will cease before the lamp is capable of reignition, resulting in lack of lamp restrike. The various elements of the circuit depicted in FIG. 3 are of such values and are so operatively connected as to provide sufficient time for hot restrike of lamps to take place.

A field effect transistor (FET), designated 70, a resistor 72 and a capacitor 74 combine to form the switch trigger rest portion of the disabler 12. As those skilled in the art will readily appreciate, the discharge of timing capacitor 66 is performed by FET 70. As has been previously mentioned, in all previous circuits serving the purpose of the circuit of the present invention, a bipolar transistor has been used to discharge timing capacitors. This practice has left a voltage residue of approximately 0.6 volts across capacitor 66. The use of FET 70 in the circuit of the present invention insures that timing capacitor 66 discharges totally, to zero voltage, for all ambient temperatures. A second aspect of the above-described trigger reset portion that those skilled in the art will readily appreciate is that it is electrically incorporated into the circuit shown in FIG. 3 so that FET 70 resets (or discharges) timing capacitor 66 upon sensing of lamp 10 ignition being accomplished, based upon voltage drop across lamp 10, as connected across terminals 30 and 32.

Various other circuit components, specifically, resistors 64, 90 capacitors 82, 76, and zener diodes 84, 86 are incorporated into the circuit of the preferred embodiment of the present invention at positions clearly set forth in FIG. 3 where they perform current resisting, filtering, and voltage limiting functions in well known manner fully understood and appreciated by those skilled in the art.

By the way of example only, a circuit such as shown in FIG. 3 could be constructed of components having designations or values as listed below.

| Element Number | Type of Element | Designation or Value |
|---|---|---|
| 50 | Inductor | 50 mH |
| 52 | Diode | 1N4001 |
| 54 | Diode | 1N4001 |
| 56 | Resistor | 120K-ohm |
| 58 | Zener Diode | 91 v, IN4763 |
| 60 | Triac | 2N6071 |
| 62 | Resistor | 3.3 MEG |
| 64 | Resistor | 220K-ohm |
| 66 | Capacitor | 33 uf, 35 V |
| 68 | PUT | 2N6027 |
| 70 | FET | 2N5640 |
| 72 | Resistor | 470K-ohm |
| 74 | Capacitor | 0.1 uf |
| 76 | Capacitor | 1.5 uF, 250 VDC/160 VAC |
| 78 | Resistor | 470K-ohm |
| 80 | Resistor | 470K-ohm |
| 82 | Capacitor | 470 uf, 16 V |
| 84 | Zener Diode | 13 V, IN4743 |
| 86 | Zener Diode | 27 V, IN4750 |
| 88 | Resistor | 820K-ohm |
| 90 | Resistor | 680K-ohm |
| 92 | Transistor | 2N3904 |

From the foregoing description and identification of circuit components, those skilled in the art will readily appreciate and understand operation of the presently preferred embodiment of the present invention. Lamp 10 voltage passes through choke 50 which filters the high voltage starting pulses from the 120 V.A.C. present at that point. Capacitor 76, placed in series with choke 50, performs a voltage dropping and current limiting function for the positive 12 V.D.C. supply. Zener diode 84, connected from the end of capacitor 76 to common line 30, limits the voltage and produces a square wave output peaked at positive 13 volts. This square wave is caused to flow through a rectifer diode 52 insuring that only positive voltage is present on filter capacitor 82 which is connected from the cathode of diode 52 to common line 30.

The timing circuit RC components are resistor 62 in series with capacitor 66 connected from the common line 30 to the positive 12 volt power supply line 51. The common point of the RC timing network is connected to the gate of PUT 68. The timing circuit functions by applying a reference voltage to the anode of PUT 68, derived from the voltage divider formed by resistors 80 and 88, to which the gate voltage is compared. When power is first applied to the circuit the gate of PUT 68 is held low and PUT 68 is turned off. As capacitor 66 charges, through current flow from resistor 62, PUT 68 voltage increases. When the gate voltage is more than the reference voltage, PUT 68 conducts and causes current to flow into the base of transistor 92. Transistor 92 then turns on and effectively causes a short circuit condition between the gate of PUT 68 and the main terminal of triac 60. Resistor 78 performs a pull-down function and ensures transistor 92 is fully turned off until PUT 68 conducts.

Triac 60 controls the connection of AC power to the ignitor 26. Triac 60 exercises such control because it is connected in series with the common line 30 and starter connection point 28, as depicted in FIG. 1. On initial power-up current flows into the gate of triac 60 via resistor 90 which limits the current. As the timing circuit comes into effect and PUT 68 and transistor 92 turn on, the triac 60 gate current ceases to flow and triac 60 turns off, preventing starter 26 of FIG. 1 from functioning. Resistor 90 ensures that voltage to the timing circuit RC components 62, 66 is maintained during the triac 60 shorting condition.

The reset function is performed by FET 70. A negative 14 V.D.C. supply, for the reset function, is generated by dropping the voltage and limiting the current, through the resistor 56 and the series zener diode 58. The diode 58 also determines a threshold voltage under which the reset is performed. The voltage is squared by the zener diode 86 connected from the cathode of zener diode 58 to the cathode of diode 52, and then rectified and smoothed by the diode 54 and capacitor 74. This negative 14 V.D.C. is connected to the gate of FET 70 and controls the discharge of timing capacitor 66. When the negative 14 V.D.C. is not present, and it would not be present when the lamp is operating, resistor 72, connected from the gate of FET 70 to the 12 V.D.C. supply, pulls the gate of FET 70 high, turning the FET 70 on and discharging or resetting capacitor 66. When the negative 14 V.D.C. is present, as it would be if the lamp voltage is high or if the lamp is bad or if there is no lamp, the gate of FET 70 is pulled low, turning it off, and allowing capacitor 66 to charge up and perform after the predetermined time delay, by energizing starter 26 of FIG. 1.

At this point, practical operation of the ignitor disabler should be readily apparent to those skilled in the art. For example, when incorporated into or retrofitted into an igniting and operating circuit for an HPS lamp and a lamp cold start is undertaken, the ignitor disabler will have no effect and the lamp will start and operate normally. Under a cold start (unlamped) condition with the ignitor disabler in the circuit the high voltage pulses will cease after the predetermined interval. If a lamp is inserted into a receptacle of a fixture under these conditions, the lamp will not ignite and it will be necessary to reset the disabler. Resetting under these conditions would entail turning the power off and on again which will lead to the lamp igniting and functioning normally. If a short power interruption were to occur, a circuit having the disabler will extinguish the lamp, and a cool down period of 30 to 60 seconds will occur before the lamp reignited. THis is identical to operation of circuits without a disabler installed, as the disabler resets itself automatically. If the lamp is faculty or if the lamp's parameters go beyond the capability of the ballast output, as in the case of a cycling "end of life" lamp, the disabler will disable the ignitor and, hence, increase its useful life. In a prior art regular system, on the other hand, the ignitor would have continued to supply high voltage, and so reduce the ignitor's operational life. It may be noted that in the case of the cycling "end of life" lamp, switching the power off and on again resets the disabler and the lamp will be reignited and run for a cycle.

With regard to method of fabrication of a circuit according to the present invention, a printed circuit board containing the circuitry as shown in FIG. 3 and potted in a can approximately 2¼ inches times 1½ inches times 2¼ inches oval, with three leads protruding outside the can for connecting purposes can be constructed by conventional techniques. Further, the can be insulated by a polyolefin heat shrink tube to prevent shorting to surrounding circuitry, also a conventional technique. An alternative construction would be to cast the circuit board in a potting compound without a separate metal can.

A unique aspect of the ignitor disabler of the present invention is its independence from the ballast. Because of this independence, the disabler can be used in conjunction with any standard ballast/ignitor currently commercially available, with appropriate adjustment of element values within the disabler in accordance with system requirements. The preferred embodiment of FIG. 3 can itself be used on any primary voltage from 120 volts to 600 volts without modification since it derives its power from the ballast secondary winding which in all cases involving lamps of 150 watts or lower provides the 120 volt open circuit voltage dictated by the arc tube voltage requirement of such lamps. Further, in all potential embodiments of the disabler of the present invention, because each is a separate unit, each can be retrofitted to any existing installation at minimum cost, since the ballast does not have to be changed to accommodate the disabler function.

Obvious, numerous modifications and variations of the present invention are possible in light of the above teachings. For example, components in the presently preferred embodiment could be changed to allow the circuit to operate satisfactorily for 100 volt ballast/lamp combinations, suitable for 150 watt, 250 watt and 400 watt H.P.S. lamps, as follows:

| Element Number | Type of Element | Designation or Value |
|---|---|---|
| 76 | Capacitor | 1.0 uF, 400 VDC/220 VAC |
| 56 | Resistor | 220K-ohm |
| 58 | Diode | IN4763 |

It is therefore to be understood that, within the scope of the appended claims, the present invention may be practiced otherwise than as specifically described hereinabove.

I claim:

1. An ignitor disabler for use with a circuit for igniting a high intensity discharge lamp, including an ignitor portion, wherein the lamp has a characteristic voltage which may vary during phases of lamp operation; said ignitor disabler comprising:
   a) means for disabling the ignitor;
   b) means for establishing a threshold voltage, which threshold voltage is higher than the characteristic voltage of the lamp under normal operating conditions;
   c) triggering means for triggering the disabling means after the passage of a predetermined amount of time, the triggering means having a timing component for measuring the predetermined amount of time, which timing component begins time measuring operation only under certain predetermined conditions;
   d) means for maintaining the length of the predetermined amount of time generally constant within a temperature range from at least one hundred (100° C.) degrees celsius to at least minus forty (−40° C.) degrees celcius; and
   e) reset means for resetting the timing component of the triggering means upon lamp ignition.

2. The invention as defined in claim 1 wherein there are means for maintaining the length of the predetermined amount of time is substantially constant over the temperature range.

3. The invention as defined in claim 2 wherein there are means for maintaining the the length of the predetermined amount of time substantially constant over the temperature range while increasing the time at lower temperatures within the range to assist in offsetting the low temperature characteristic of the lamp.

4. The invention as defined in claim 3 wherein the lamp is a high pressure sodium lamp and the certain predetermined conditions under which the timing component begins time measuring operations include all conditions in which the characteristic voltage of the lamp exceeds the threshold voltage.

5. The invention as defined in claim 4 wherein the ignitor disabler further comprises:
   a) means for receiving AC power; and
   b) a power supply portion which converts alternating current (AC) to direct current (DC) effectively dividing the ignitor disabler into an AC part and a DC part.

6. The invention as defined in claim 5 wherein the means for establishing the threshold voltage operates in the AC part of the ignitor disabler.

7. The invention as defined in claim 1 wherein the timing component comprises:
   a) a timing capacitor; and
   b) a field effect transistor for performing discharge of the timing capacitor to an effective zero (0) volt level.

8. The invention as defined in claim 6 wherein the timing component comprises:
   a) a timing capacitor; and
   b) a field effect transistor for performing discharge of the timing capacitor to an effective zero (0) volt level.

9. The invention as claimed in claim 8 wherein the disabling means is a bi-directional triode thyristor (triac) which is connected in such a manner that when the triac is turned off it prevents the ignitor from functioning.

10. The invention as defined in claim 9 wherein the trigger means comprises:
   a) a field effect transistor which is biased to be turned off under the predetermined conditions;
   b) a capacitor which is discharged when the field effect transistor is turned on and charges when the field effect transistor is turned off;
   c) a programmable unijunction transistor which is biased to be turned on when the voltage across the capacitor exceeds a reference voltage; and
   d) a bipolar junction transistor biased to be turned on when the programmable unijunction transistor conducts and causes current to flow into the base of the bipolar transistor, thereby turning off the triac.

11. The invention as defined in claim 10 wherein the reset means is a circuit with output connected to the gate of the field effect transistor, the circuit being adapted to turn the field effect transistor on upon sensing lamp ignition being accomplished.

12. An apparatus for connection across an AC source for disabling an ignitor for a high intensity discharge lamp, said lamp having a characteristic voltage that varies during the life of the lamp, said apparatus comprising:
   a) input terminals adapted to be connected across said AC source and said lamp;
   b) means for establishing a threshold voltage, which threshold voltage is higher than the characteristic voltage of the lamp under normal operating conditions;
   c) means for producing an ignitor disabling signal under certain predetermined conditions, wherein one of the predetermined conditions is when the characteristic voltage of the lamp exceeds the threshold voltage;

d) output means adapted to be coupled to said ignitor for transmission of said ignitor disabling signal to said ignitor;

e) switching means for engaging the signal producing means;

f) triggering means for said switching means;

g) means for measuring the elapsed time from condition of presence of power within the apparatus and failure of lamp to ignite;

h) means for causing operation of said trigger means after passage of a predetermined amount of time wherein the length of the predetermined amount of time is maintained generally constant over temperatures ranging from at least one hundred (100° C.) degrees Celsius to at least minus forth (−40° C.) degrees celcius, in the absence of automatic reset of said triggering means; and i) means for automatically resetting said triggering means on condition of lamp ignition.

13. The apparatus of claim 12 further comprising means for sensing presence of power within the apparatus and failure of the lamp to ignite.

14. The apparatus of claim 13 wherein said means for sensing presence of power within the apparatus and failure of the lamp to ignite comprises AC voltage threshold establishing means.

15. The apparatus of claim 14 wherein said triggering means for said switching means comprises a field effect transistor.

16. A circuit for a high intensity discharge lamp with a characteristic voltage that varies during the life of the lamp, comprising:

a) an ignitor connected to the lamp for igniting the lamp when the lamp is turned off;

b) an ignitor disabler connected to said ignitor and to the lamp;

said ignitor disabler including detecting means for detecting abnormal operation of the lamp and connected to generating means for generating a disabling signal and transmitting said signal to said ignitor, and connected to said ignitor;

wherein said detecting means monitors the characteristic voltage of said lamp, and said generating means generates a disabling signal after passage of a predetermined amount of time, there being means for maintaing the length of the predetermined amount of time generally constant over temperatures ranging from at least one hundred (100° C.) degrees Celsius to at least minus forth (−40° C.) degrees Celsius, when said detecting means detects a voltage in excess of a predetermined maximum characteristic voltage for the lamp; and said generating means transmits the disabling signal to said ignitor when said detecting means detects abnormal lamp operation.

17. A circuit according to claim 16 wherein said generating means includes:

a) means for triggering the disabling signal; and b) means for resetting the triggering means; said resetting means connected to said detecting means and said triggering means connected to said resetting means.

18. A circuit according to claim 17 wherein said triggering means includes a timing means.

19. A circuit according to claim 18 wherein:

a) said resetting means includes a field effect transistor for resetting the timing means; and b) the resetting means resets said triggering means when said resetting means receives a signal from said detecting means.

* * * * *